US005315741A

United States Patent [19]

Dubberke

[11] Patent Number: 5,315,741

[45] Date of Patent: May 31, 1994

[54] SNAP FASTENER FOR SECURING SHOE LACES

[75] Inventor: Markus Dubberke, Mögglingen, Fed. Rep. of Germany

[73] Assignee: Nicole Dürr GmbH, München, Fed. Rep. of Germany

[21] Appl. No.: 90,215

[22] PCT Filed: Mar. 24, 1993

[86] PCT No.: PCT/EP93/00715

§ 371 Date: Sep. 2, 1993

§ 102(e) Date: Sep. 2, 1993

[87] PCT Pub. No.: WO93/18678

PCT Pub. Date: Sep. 30, 1993

[30] Foreign Application Priority Data

Mar. 24, 1992 [DE] Fed. Rep. of Germany ..... 4209425

[51] Int. Cl.[5] ..... A43C 7/00

[52] U.S. Cl. ..... 24/712.1; 24/712.3; 24/712.6; 24/115 G

[58] Field of Search ..... 24/712, 712.1, 712.5, 24/712.6, 714.1, 115 M, 590, 573.1, 115 G, 712.3; 403/211; 36/50.1, 1

[56] References Cited

U.S. PATENT DOCUMENTS

| | | | |
|---|---|---|---|
| 948,071 | 1/1910 | Lubeck . | |
| 3,057,029 | 10/1962 | Miller, Jr. et al. | 24/712.6 |
| 3,290,745 | 12/1966 | Maxwell et al. | 24/712.6 |
| 3,345,707 | 10/1967 | Rita . | |
| 3,500,508 | 3/1970 | Bennett . | |
| 3,908,238 | 9/1975 | Panicci . | |
| 4,790,048 | 12/1988 | Arnt | 24/712.1 |

FOREIGN PATENT DOCUMENTS

| | | |
|---|---|---|
| 0314628 | 5/1989 | European Pat. Off. . |
| 1518038 | 3/1968 | France . |
| 937788 | 9/1963 | United Kingdom . |

*Primary Examiner*—Victor N. Sakran
*Attorney, Agent, or Firm*—Burns, Doane, Swecker & Mathis

[57] ABSTRACT

A snap fastener for securing shoe laces comprises two openings disposed diametrically to each other through which the shoe laces are passed. The openings extend longitudinally through the snap fastener when the latter is opened. An inner sleeve is in a larger outer sleeve such that it is longitudinally movable relative thereto. The inner sleeve accommodates an inner ring. When the pressure is exerted on the outer sleeve, the ring is made to rotate as the longitudinal movement is converted into a horizontal circular movement so that the shoe laces are immovably clamped by the snap fastener.

36 Claims, 10 Drawing Sheets

SNAP FASTENER FOR SECURING SHOE LACES

BACKGROUND OF THE INVENTION

The present invention relates to a snap fastener for securing shoe laces.

Especially for kindergarten children who are not yet able to tie shoe laces on their own, a device eliminating the need for tying shoe laces is very useful. Proposals for such a device have been made in EP 0 314 628 A2, FR 1.518.038 and U.S. Pat. Nos. 3,500,508, 3,345,707 and 948,071. The present invention is based on the object of providing an improved device of this kind which is even easier to handle.

SUMMARY OF A PREFERRED EMBODIMENT OF THE INVENTION

According to the invention, this object is solved by a snap fastener for securing shoe laces which is characterized by the following features:

an inner sleeve is guided within an outer sleeve so that the two sleeves are substantially movable toward and away from each other;

the inner sleeve accommodates an inner body which is rotatably mounted;

there are means for effecting rotation of the body upon relative movement between the inner sleeve and the outer sleeve;

at least one opening permits the lace to be passed therethrough;

each of the openings is formed by a borehole extending through the inner sleeve, the body and the outer sleeve;

the boreholes of the inner sleeve, the body and the outer sleeve associated with each of the openings are in alignment with one another when the snap fastener is in the unlocking or releasing position so that the shoe lace can be readily passed therethrough;

a relative movement between the inner sleeve and the outer sleeve from the unlocking position effects displacement of the boreholes whereby the shoe lace is immovably clamped;

preferably, two openings offset relative to each other are provided through which one shoe lace each is passed.

The snap fastener according to the invention also prevents the shoe laces from becoming undone on their own. The circular movement of the inner ring ensures reliable clamping of the shoe laces.

The snap fastener according to the invention allows for the simple and fast securing of shoe laces on any kind of shoes, particularly children's shoes.

Since the tying of shoes has been practiced for thousands of years but no absolutely safe method of tying and easily releasing shoe laces has been found so far, the solution according to the present invention provides the opportunity of durably securing and releasing the shoe laces on shoes by way of a simple movement of the hand.

By knotting the ends of the shoe laces, the shoe laces can be prevented from inadvertently getting out of the snap fastener.

The snap fastener is advantageously designed such that it comprises two openings offset relative to each other for passing one end of a shoe lace each therethrough, the ends of the shoe laces being preferably bent at right angles at least once when the inner and outer sleeves are pressed together. Said bending of the shoe laces is reversed when the inner and outer sleeves are pulled apart again. When pressure is exerted on the outer sleeve, the body is made to rotate on account of the vertical movement being converted into a horizontal circular movement so that the shoe laces are immovably clamped by the snap fastener. They are released upon a slight upward drawing action.

According to a preferred embodiment of the invention, the inner body comprises at least one surface bevelled in relation to the rotational axis of the body, said bevel substantially extending in the circumferential direction of the body. Opposite the bevelled surface there is provided a projection which slides on the bevelled surface upon relative movement of the inner and outer sleeves towards each other, thus turning the body. The bevelled surface preferably starts from a side of the body which extends substantially vertically to the axis of rotation of the body.

According to a particularly preferred embodiment of the invention, the body comprises two bevelled surfaces, with a projection being disposed opposite each of the bevelled surfaces. The projections are suitably arranged on the inner surface of the sleeve opposite the bevelled surface, preferably on the inside of the outer sleeve.

According to a further development of the invention, means are provided for limiting the maximum extent to which the two sleeves can be pulled apart. Further means advantageously prevent the inner and outer sleeves from being rotated relative to each other.

The rotatably mounted body is operatively connected with at least one spring which counteracts the rotation of the body caused by the relative movement between the inner and outer sleeves during the securing operation and which resets the rotatably mounted body when the securing state is released.

In a particularly simple configuration, the inner and outer sleeves are designed in a circular cylindrical manner and the rotatably mounted body comprises a circular cylindrical circumferential surface guided by the inner wall of the inner sleeve, the rotatably mounted body being preferably designed in the form of a ring. When at least one of the sleeves is provided with an axially extending hub around the outside of which the ring is rotatably mounted, a particularly stable support ensuring reliable rotation of the ring is obtained. When, according to another embodiment of the invention, one of the sleeves preferably comprises an axially extending projection in the middle, said projection being displaceably guided in a cylindrical recess provided in an axially extending projection of the other sleeve, a particularly stable construction of the snap fastener is obtained which facilitates the handling thereof. Preferably, the axially extending projection with the cylindrical recess is designed as a central hub which guides the ring or effects mounting of the spring.

The highest clamping effect is achieved when the boreholes extend through the rotatably mounted body parallel to the axis of rotation thereof, as each end of the shoe lace then forms a 360° loop.

So as to prevent the rotatably mounted body from canting, the boreholes through which the shoe laces are threaded preferably extend through the rotatably mounted body on diametrically opposed sides. For the same reason, the bevelled surfaces are preferably arranged diametrically opposite each other, too; advantageously, they are arranged in a mirror symmetrical manner.

According to a preferred embodiment, the boreholes extending through the rotatably mounted body and the bevelled surfaces arranged on said body are offset, in relation to the axis of rotation of said body, by about 90° relative to each other.

According to a particularly preferred embodiment of the invention, a small cover plate is provided between the rotatably mounted body and the outer sleeve, said cover plate being held at the inner sleeve and comprising boreholes which are in alignment with the boreholes of the outer sleeve and thus enable the shoe laces to be passed therethrough. The small cover plate suitably also comprises through-holes disposed above the bevelled surfaces of the rotatably mounted body so that projections on the outer sleeve, extending through the through-holes, can act on the bevelled surfaces in order to rotate the rotatably mounted body to lock the shoe laces in place. Due to the circular movement of the rotatably mounted inner body, the threaded shoe laces are drawn into joints between the inner surface of the inner sleeve and the rotatably mounted body and between said body and the inner surface of the small cover plate where they are clamped.

In order that the joints and hence the play between the movable parts may be kept small, flat depressions are preferably provided in the end portion of the boreholes of the rotatably mounted body against the direction of rotation taken in the securing operation; in said depressions, the ends of the shoe laces can be clamped. The clamping effect is enhanced when portions of the depressions are additionally provided with a friction-increasing surface.

The snap fastener can be operated in a particularly simple manner when the outer sleeve comprises a protruding gripping portion.

Shaping of the components which are preferably injection molded is particularly easy when the snap fastener has a cylindrical configuration, which makes it also possible to manufacture stable snap fasteners at a minimum expense of material.

According to another modification of the invention, the free end portions of the shoe laces are detachably held in shaped parts larger than the openings so as to prevent the shoe laces from being inadvertently withdrawn from the snap fastener. The shaped parts preferably comprise a through-bore as well as an additional borehole adjacent the one end of the through-bore, into which borehole the free end of the end portion of the shoe lace threaded through the through-bore can be inserted.

According to a further aspect of the invention, a snap fastener for securing shoe laces is provided which exhibits the following features:

the snap fastener has a cylindrical shape;

the shoe laces are passed through two openings arranged diametrically to each other;

the openings extend longitudinally through the snap fastener when the latter is open;

an inner sleeve is guided in a larger outer sleeve so that it is longitudinally movable thereto;

the inner sleeve accommodates an inner ring;

when pressure is exerted on the outer sleeve, the ring is made to rotate as the vertical movement is converted into a horizontal circular movement so that the snap fastener clamps the shoe laces such that they are immovable, while they are released when a slight upward drawing force is applied.

Particularly reliable securing of the shoe laces is effected by providing a small intermediate cover plate, the threaded shoe laces being drawn into joints between the inner circular surface of the inner sleeve and the inner circular surface of the cover plate and clamped on account of the circular movement of the inner ring.

According to a preferred embodiment of the invention, the inner ring comprises two bevelled through-holes while the outer sleeve includes two pins which act on the bevelled through-holes when pressure is exerted on the outer sleeve and translate the vertical movement into a horizontal circular movement of the inner ring.

BRIEF DESCRIPTION OF THE DRAWING

The invention will be further explained with reference to the accompanying drawings and the following description, wherein FIGS. 1 to 8 show the individual components of a preferred embodiment of the snap fastener according to the invention, while FIGS. 9 to 14 illustrate the cooperation thereof.

FIG. 1 is a top plan view of a circular cylindrical inner sleeve foxing the lower part of the snap fastener;

FIG. 2 is a sectional view taken along the line II—II of FIG. 1 through the inner sleeve of FIG. 1;

FIG. 3 is a top plan view of the underside of a circular cylindrical outer sleeve having a larger diameter, in which the inner sleeve shown in FIGS. 1 and 2 is vertically displaceably guided, the term "vertical" referring to the direction of the arrow D in FIGS. 2 and 4;

FIG. 4 is a sectional view taken along the line IV—IV of FIG. 3 through the outer sleeve of FIG. 3;

FIG. 5 a top plan view of an inner ring accommodated in the inner sleeve and rotatable relative thereto;

FIG. 6 is a side elevational view of the inner ring shown in FIG. 5 in the direction of the arrow VI of FIG. 5;

FIG. 7 shows a small cover plate fitted into the inner sleeve upon insertion of the ring;

FIG. 8 is a sectional view taken along the line VIII—VIII of FIG. 7 through the small cover plate shown in FIG. 7;

FIG. 9A shows the snap fastener in a position where the shoe laces are freely movable, while FIG. 9B represents the snap fastener in a position where each of the shoe laces is locked in place by a 360° loop;

FIG. 10A shows the operating position according to FIG. 9A, FIG. 10B represents the operating position according to FIG. 9B;

FIGS. 11–14 show sectional views of the assembled snap fastener, wherein FIGS. 11 and 12 represent the operating position shown in FIGS. 9A and 10A, and FIGS. 13 and 14 represent the operating position shown in FIGS. 9B and 10B.

DETAILED DESCRIPTION OF A PREFERRED EMBODIMENT OF THE INVENTION

Figure 9A:
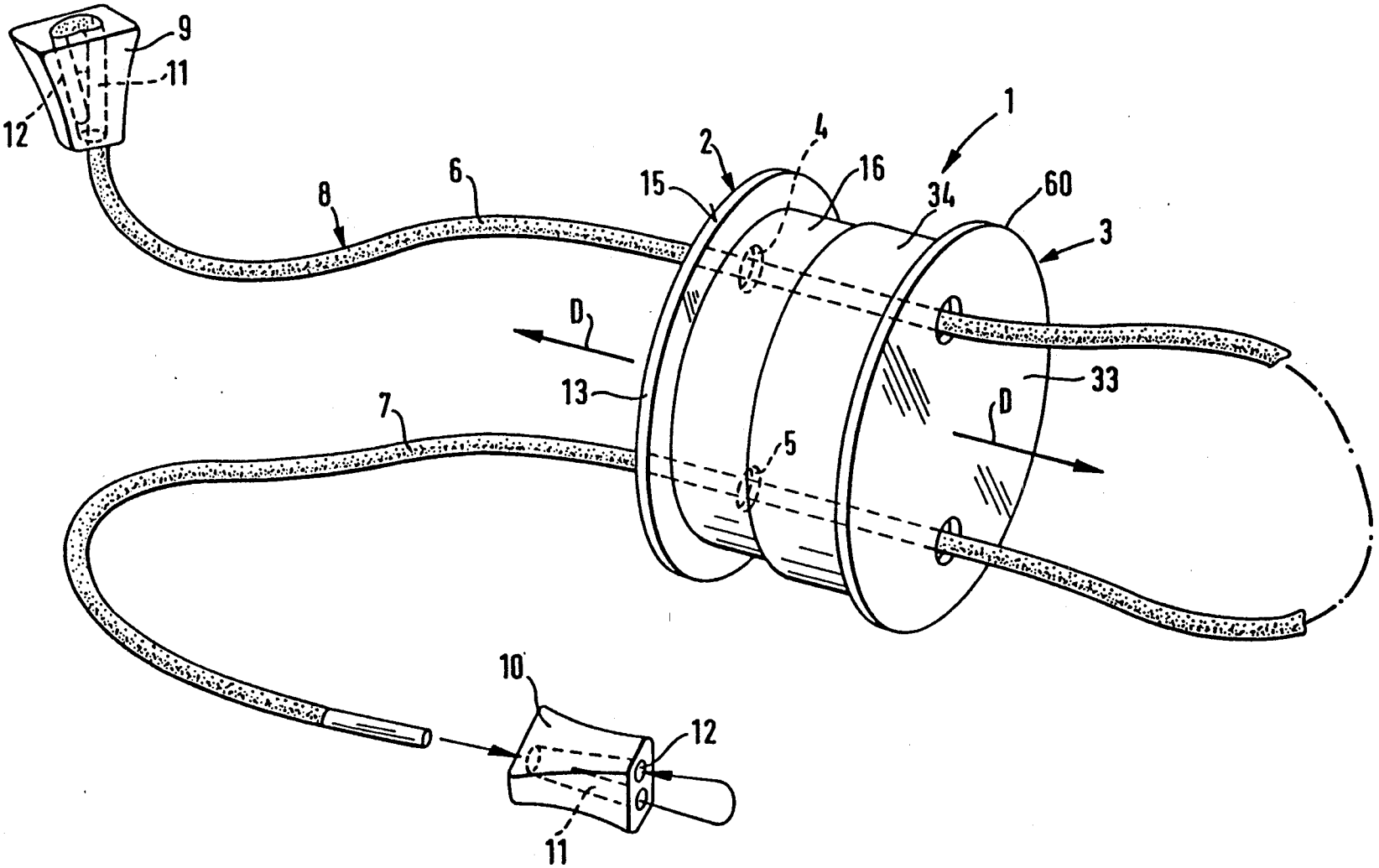
FIGS. 9*a* and 9*b* are perspective view of the snap fastener composed of the component parts shown in FIGS. 1 to 8 in operation with threaded shoe laces and shaped parts attached to the end portions thereof.
Figure 9B:
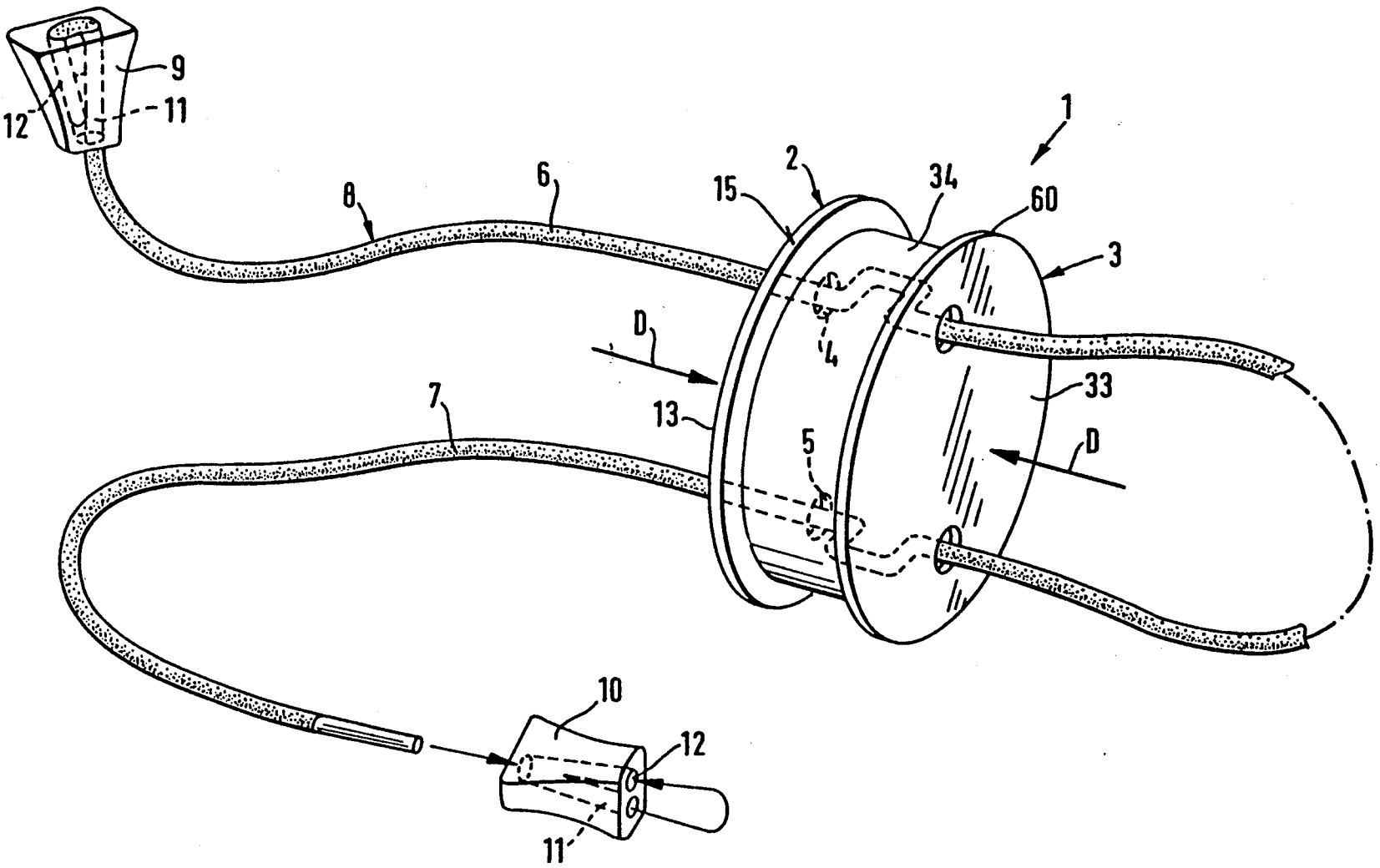
Figure 10A:
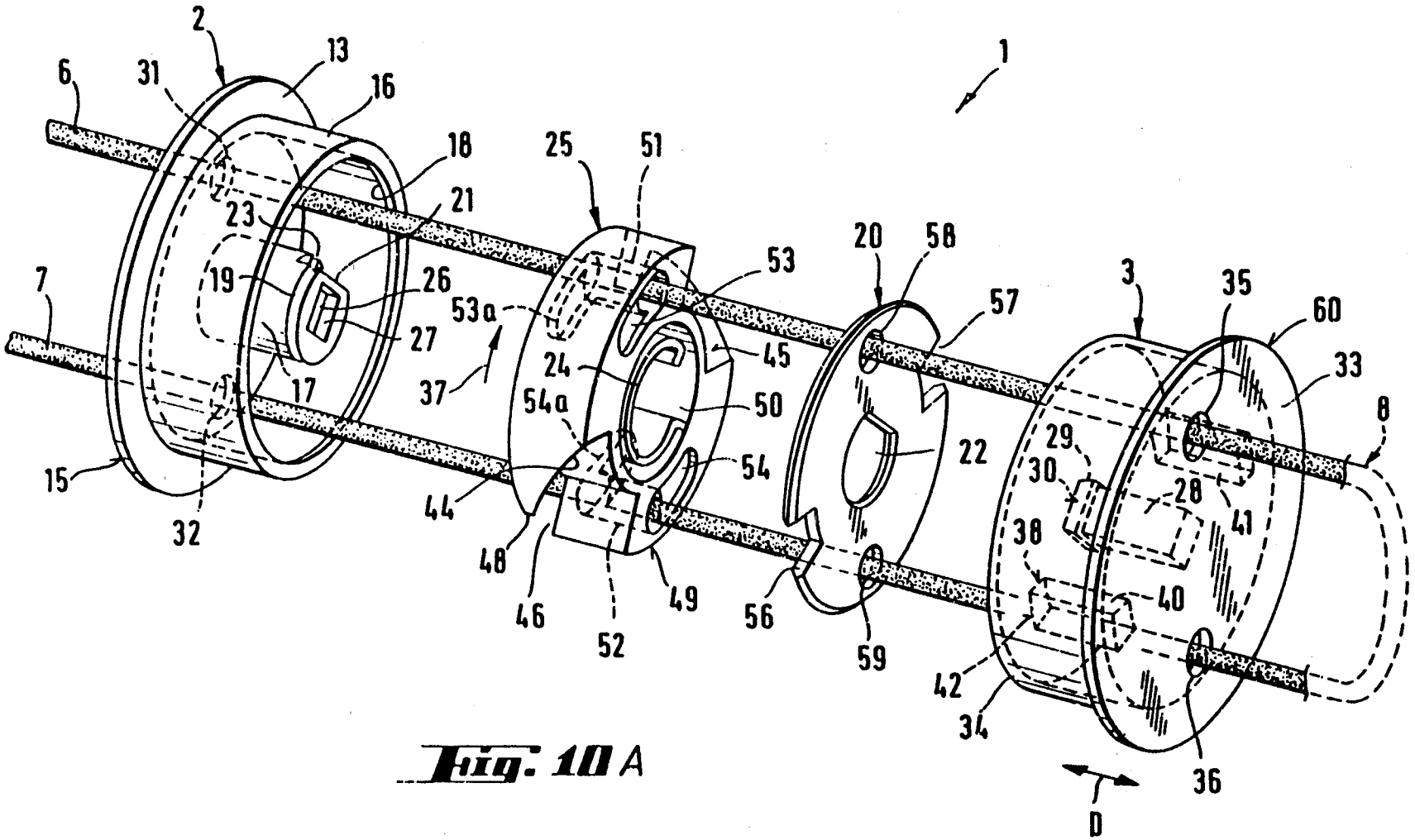
FIGS. 10*a* and 10*b* exploded perspective view of the snap fastener with threaded shoe laces.
Figure 10B:
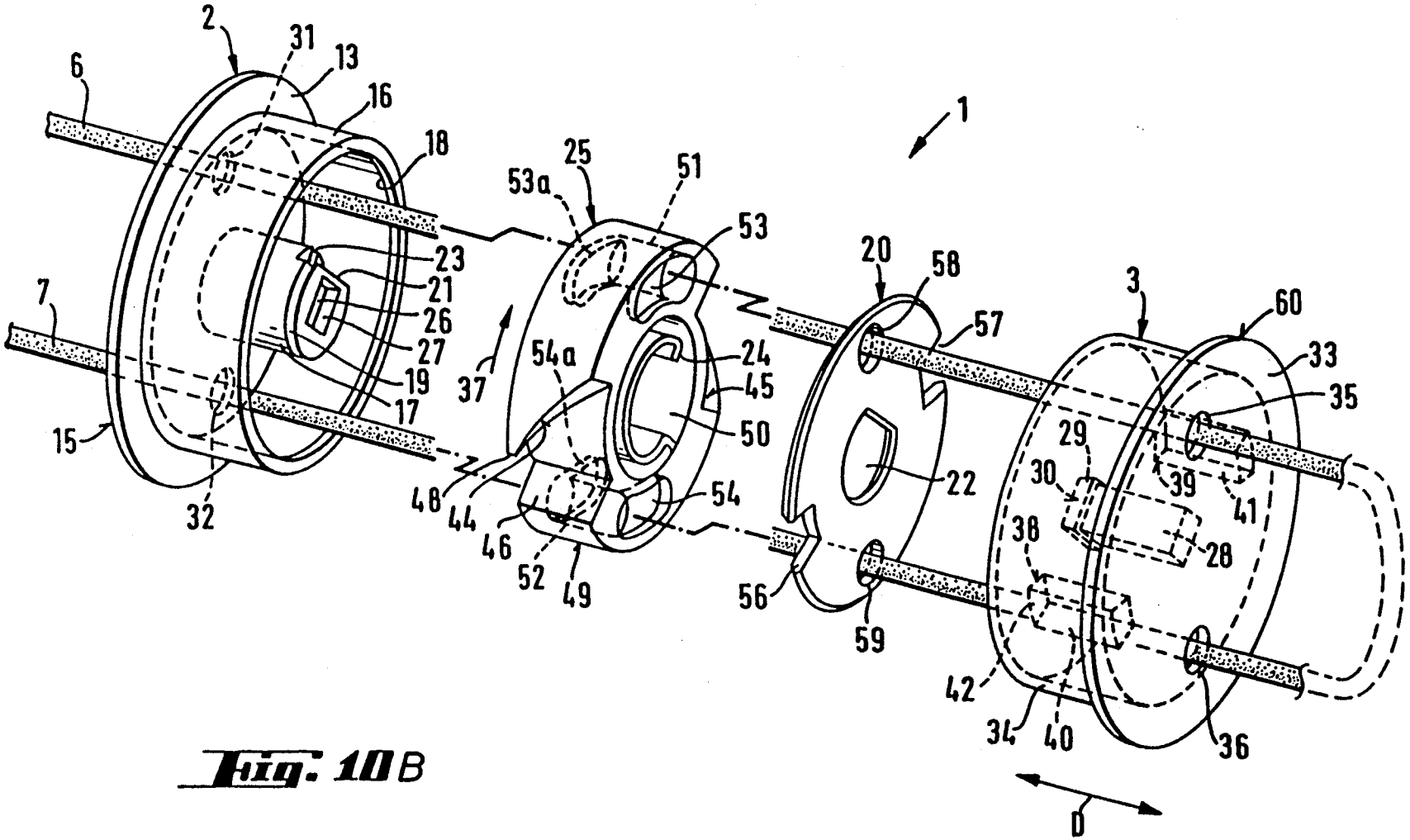

The figures depict an embodiment of a snap fastener 1 whose outside view and mode of operation are illustrated in FIGS. 9A and 9B for reasons of clarity.

The snap fastener 1 comprises a circular cylindrical inner sleeve 2 and a circular cylindrical outer sleeve 3 which is guided in a slidably displaceable manner on the outside of the inner sleeve 2 so that the sleeves 2 and 3 can be telescoped, i.e. pushed together and pulled apart, as indicated by the arrow D. The sleeves 2, 3 form a housing. The snap fastener 1 comprises, relative to the longitudinal axis thereof which coincides with the arrow D as shown, two diametrically opposed passageways 4 and 5 through which the end portions 6 and 7 of a shoe lace 8 are passed. The shoe lace is threaded through the snap fastener in a rectilinear and loose manner as indicated by dash lines in FIG. 9A when the snap fastener 1 is in the operating position as shown in FIGS. 9A, 10A and 11, 12. The shoe lace extends through the snap fastener 1 such that it is twice bent at right angles as indicated by dash lines in FIG. 9B when the snap fastener is in the operating condition as shown in FIGS. 9B, 10B and 13, 14 so that each end portion 6, 7 of the shoe lace forms a 360° loop in the region of the snap fastener 1.

The free end portions 6, 7 of the shoe lace 8 carry shaped parts 9 and 10 comprising a through-bore 11 and another borehole 12 which is disposed adjacent the one end of the through-bore 11 and allows for the insertion of the tips of the shoe lace end portions 6 and 7, respectively, which are threaded through the through-bore 11, after being bent by about 180° so that the shaped parts lock the end portions in place after retraction thereof. In this manner, the end portions are prevented from inadvertently being drawn out of the snap fastener 1. Alternatively, this objective can also be achieved without the shaped parts 9, 10 by providing the end portions 6 and 7 with a knot, which is not shown in the drawings, however.

Figure 2:
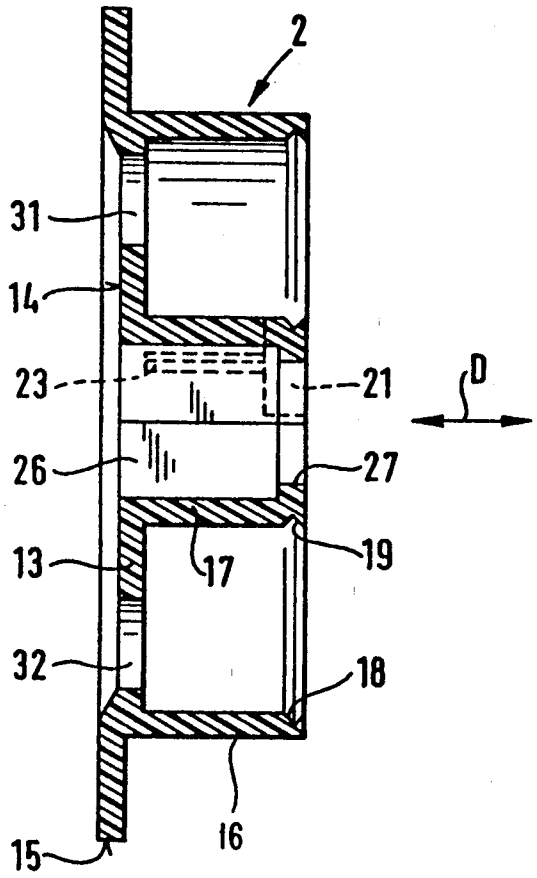
Figure 1:
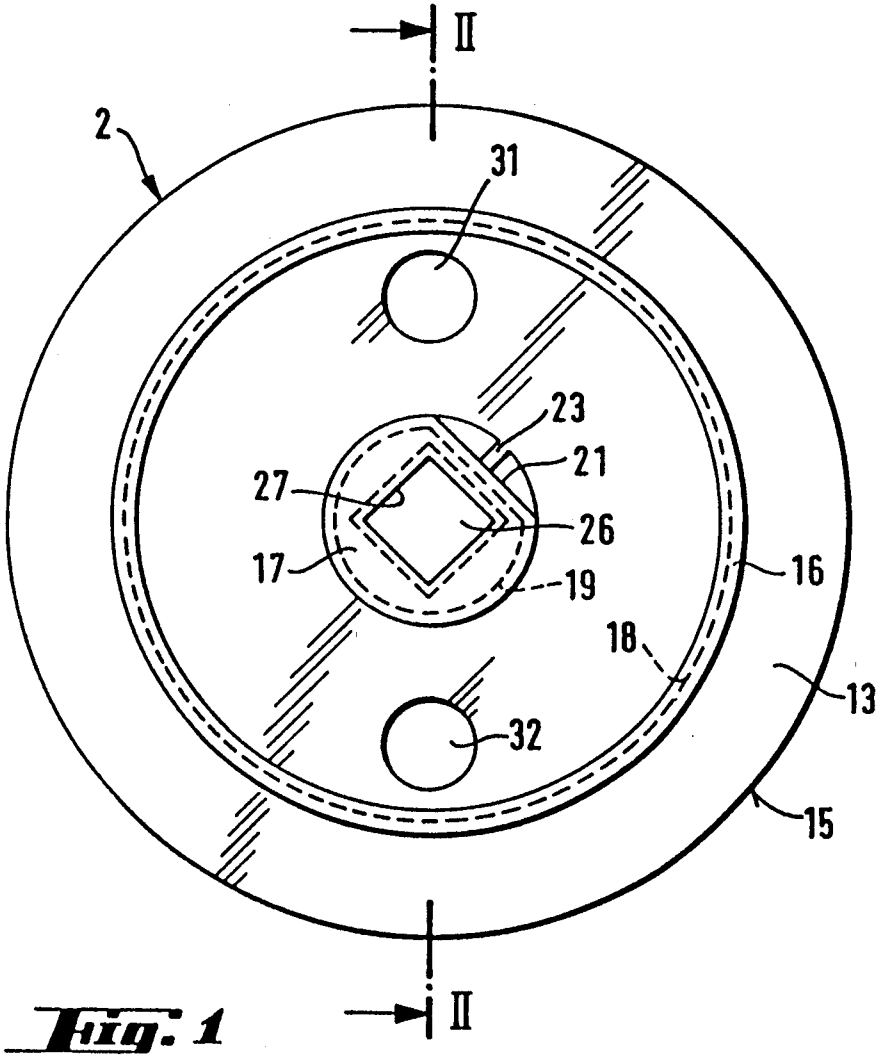
Figure 8:
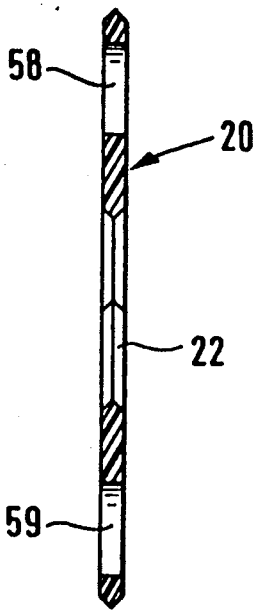
Figure 7:
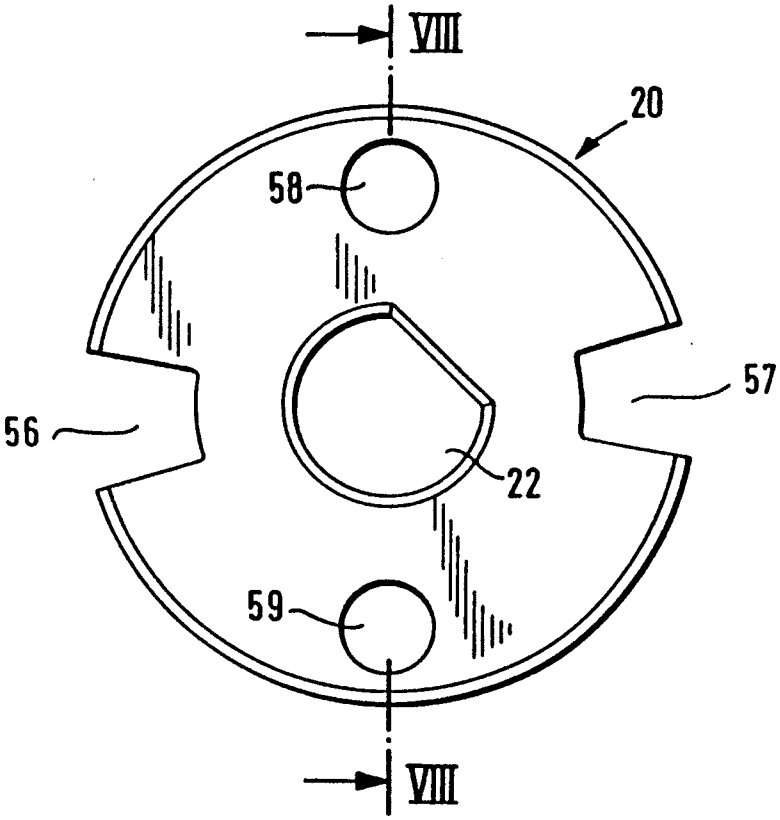

In the following, the snap fastener is explained in more detail:

As can be seen from FIGS. 1 and 2, the inner sleeve 2 comprises a circular disk-shaped bottom 13 which is drawn in like a plate on the outside, as indicated by reference number 14. A circular cylindrical side wall 16 is unitarily fixed to the inside of the bottom 13 and set back radially inwardly relative to the rim 15 thereof, as well as a hub 17 which is of a circular cylindrical shape at least in the lower region thereof. The side wall 16 and the hub 17 are arranged concentrically to each other, the center line thereof defining the center line of the snap fastener. A circumferential groove 18 is disposed at the upper inside portion of the ring-shaped pot formed by the side wall 16, the upper side of the bottom 13 and the upper side of the hub 17. The groove 18 is formed in the inside of the side wall 16. A circumferential groove 19 is disposed on the upper outside portion of the hub 17 at the same height as the groove 18. Into those grooves 18, 19 a small cover plate 20 shown in FIGS. 7 and 8 can be pressed to close the pot at the top.

The hub 17 also includes, in the region of the upper end thereof, a lateral flattened portion 21 which, in cooperation with a correspondingly shaped central recess 22 of the small cover plate 20 prevents said cover plate from rotating about the center line.

Figure 6:
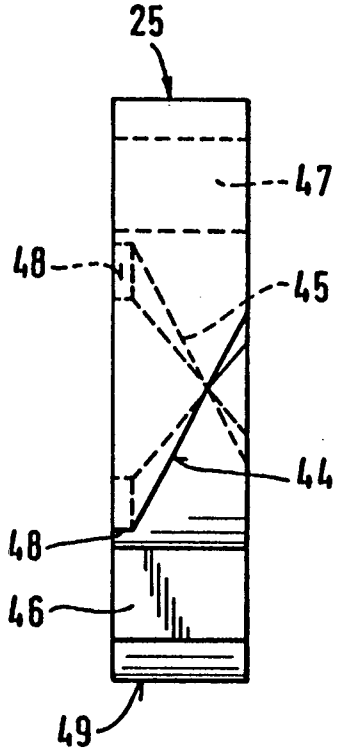
Figure 5:
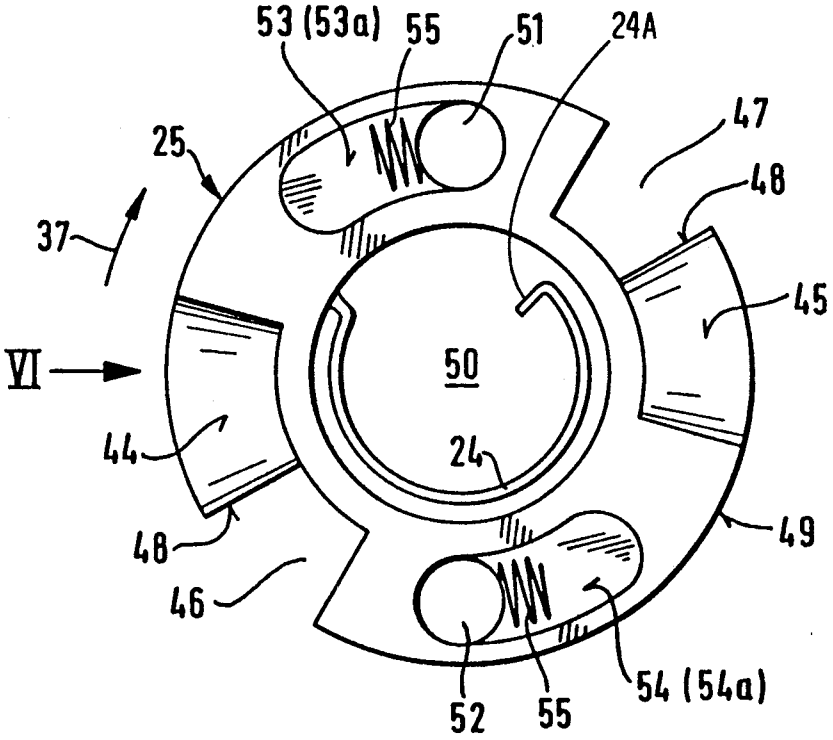

The hub also comprises a longitudinal slot 23 into which the free end 24*a* of a leaf spring 24 can be inserted, said leaf spring being attached to an inner body or a circular ring 25 shown in FIGS. 5 and 6 which is accommodated in the pot of the inner sleeve 2.

Figure 4:
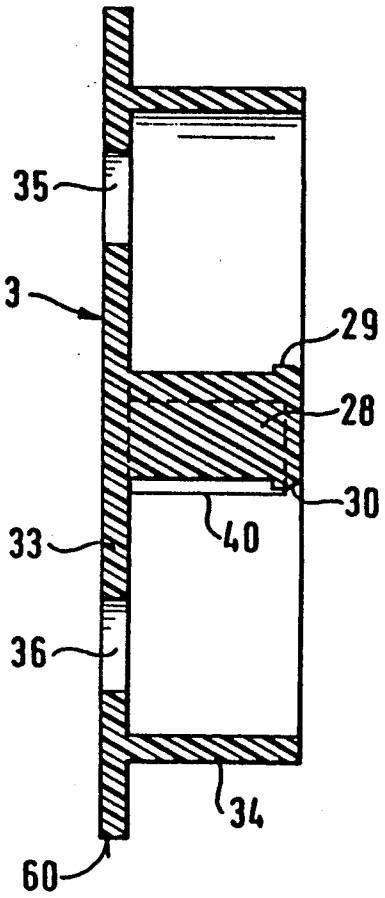
Figure 3:
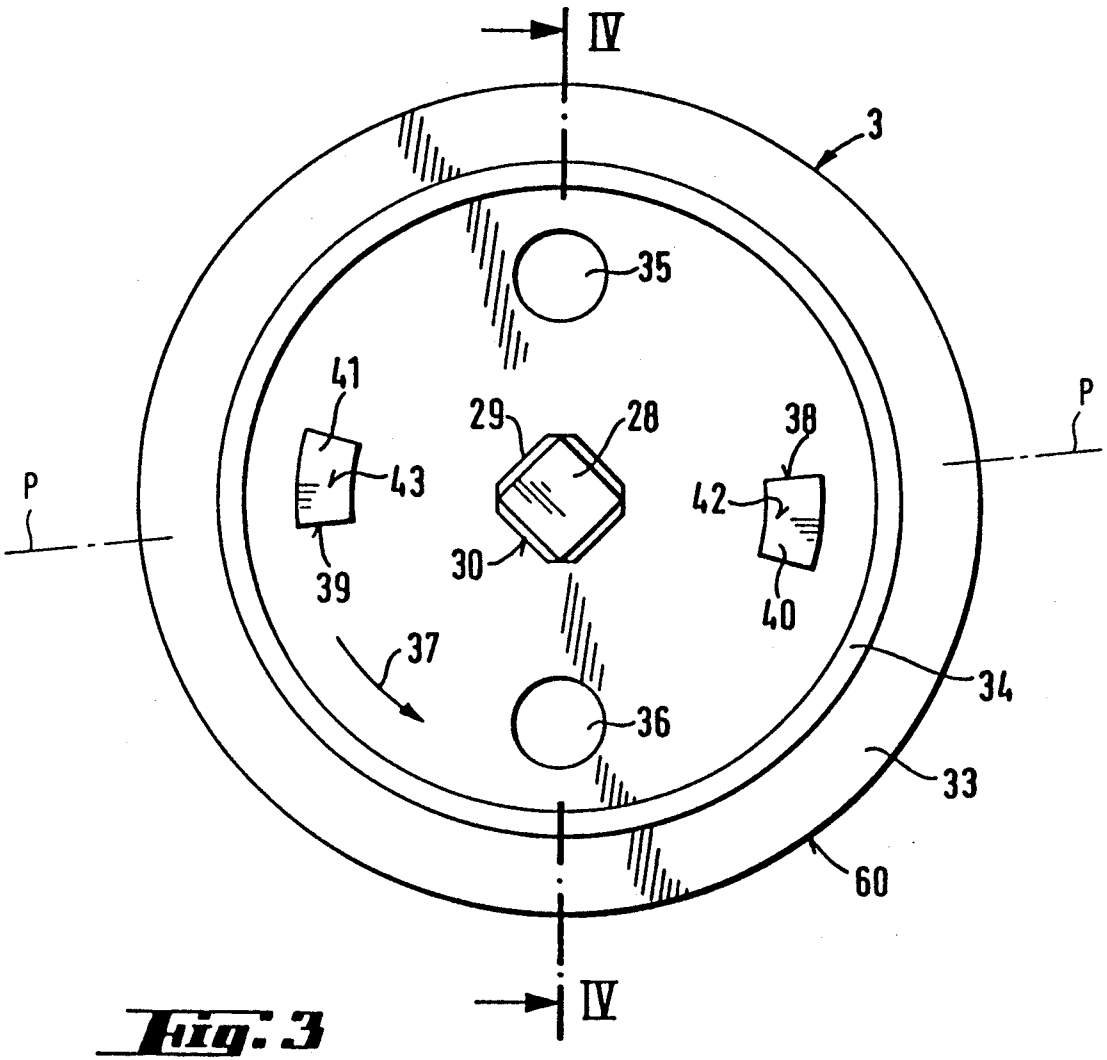

The hub 17 comprises, in the interior thereof, a hollow 26 having a square cross-section and extending over the entire length of said hub, said hollow being constricted at the upper end thereof by a collar 27. A journal 28 projecting like a jut centrally on the inside of the outer sleeve 3 as shown in FIGS. 3 and 4 is guided in a slidably displaceable manner in the hollow 26, the outer contour of said journal 28 corresponding to the inner contour of the hollow 26. The journal is provided at the free end thereof with a jut-like enlargement 29. The collar 27 prevents, in cooperation with the enlargement 29, the journal 28 from being pulled out of the hollow 26 as soon as the journal 28, overcoming the elastic deformability of the material forming the enlargement 29 and the collar 27 and supported by a cut-off upper edge 30 of the journal 28, is pressed into the hollow 26 during assembly of the snap fastener 1. The collar 27 and the enlargement 29 thus prevent the snap fastener 1 from being pulled apart beyond the open position shown in FIG. 9A.

All components of the snap fastener are preferably made of plastics.

In the bottom 13 of the inner sleeve, two through-bores 31, 32 forming the respective entrances to the passageways 4 and 5 are disposed on diametrically opposed places in the region of the pot and adjacent the side wall 16 thereof.

Figure 11:
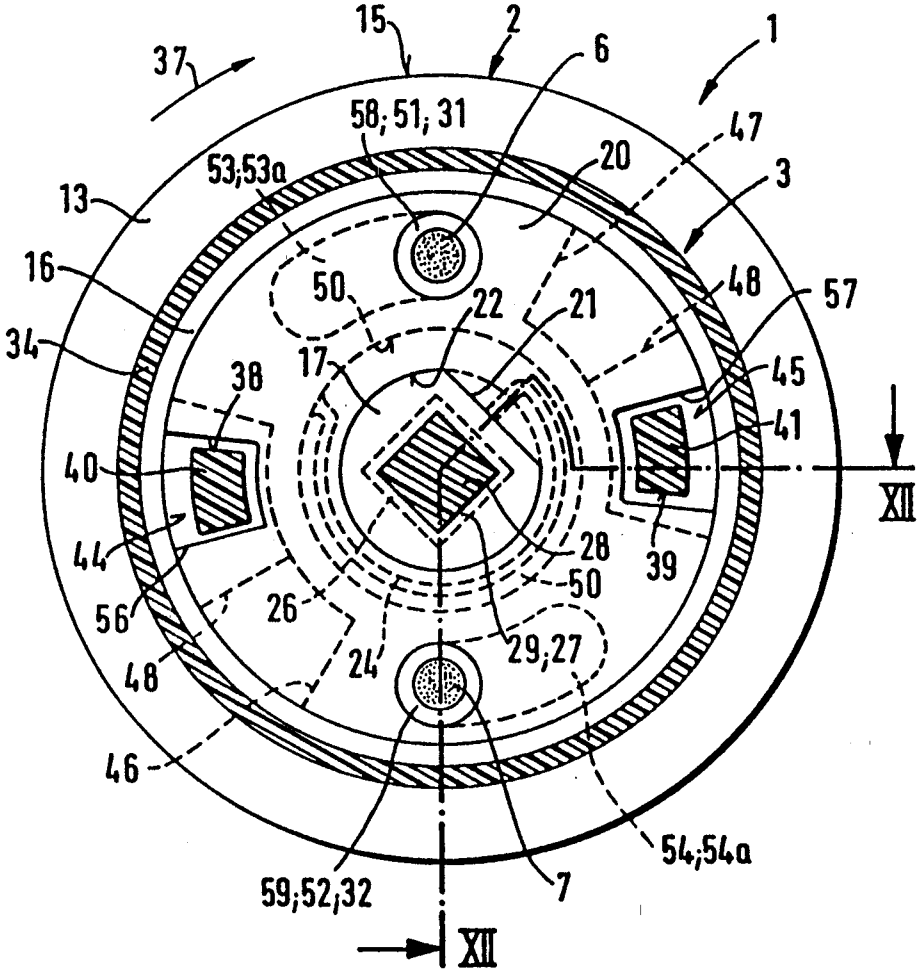
Figure 14:
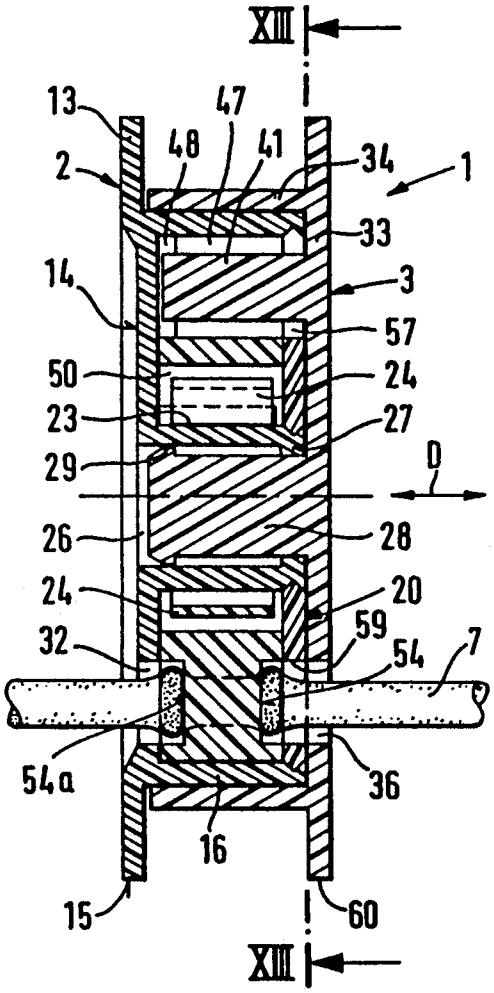
Figure 13:
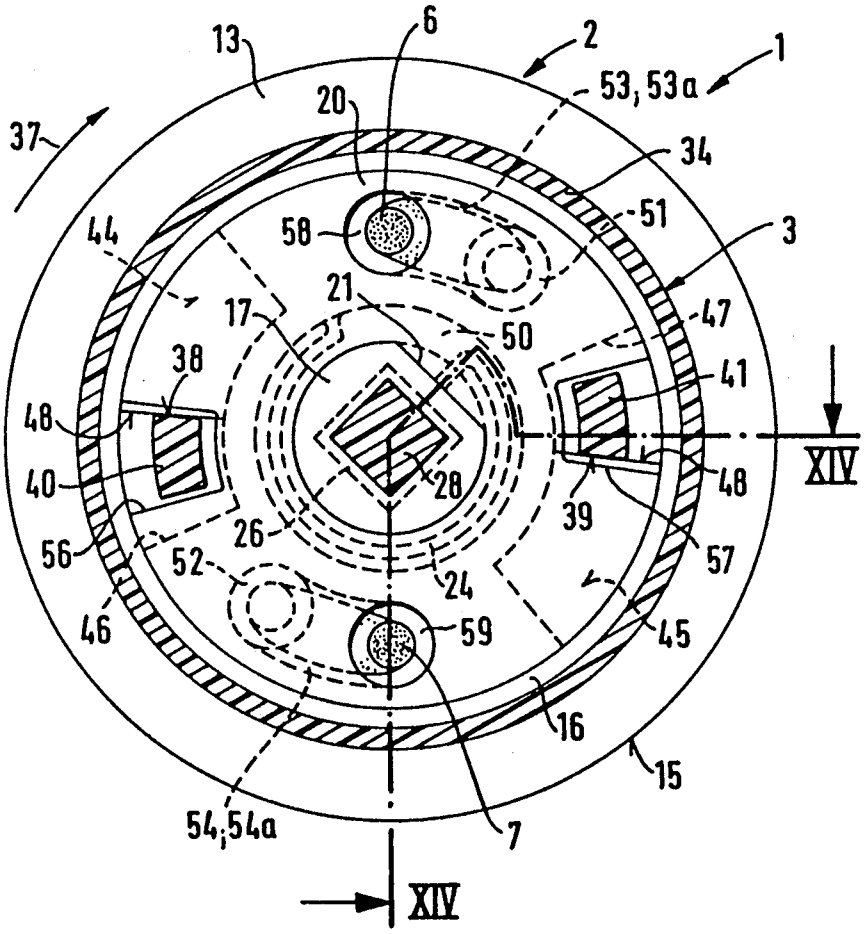

The outer sleeve 3 shown in FIGS. 3 and 4 includes a circular cover 33 on the inside of which there is integrally formed a set-back or radially inwardly offset circular cylindrical side wall 34 which is displaceable outside of and along the cylindrical side wall 16 of the inner sleeve 2 as shown in FIGS. 9A and 11, in particular. In the preferred embodiment shown, the side walls 16 and 34 have the same height or longitudinal length, which results in optimum guidance and prevents dirt from getting inside the snap fastener. In the cover 33, further boreholes 35, 36 are provided which define the respective outlets of the passageways 4, 5 and are in alignment with the openings 31, 32 when the sleeves 2 and 3 are assembled as mentioned above. Two actuator pins 40, 41 project in a jut-like manner from the inside of the circular cover 33 parallel to the center line of the snap fastener. The pins 40, 41 include respective rear flanks 38, 39 which lie in a plane P that is oriented orthogonally to a plane (coinciding with the line IV—IGV in FIG. 3). The flanks 38, 39 are considered to be "rear" flanks with respect to a direction of rotation 37 of the ring 25 (FIG. 5) during a securing operation as will later be explained. Front faces 42, 43 of respective pins 40, 41 face towards the upper edge portion of bevelled surfaces 44, 45 of the ring 25 in the operating condition as shown in FIGS. 9A, 10A and 11, 12, said bevelled surfaces unilaterally defining through-holes 46, 47 on the edge portion of the circular ring 25. The length of the pins 40, 41 is dimensioned such that the pins slide along the bevelled surfaces 44, 45 when the sleeves 2, 3 are pushed together in the direction of the operating position as shown in FIGS. 9B, 10B and 13, 14, until they assume a final position in which they are disposed in the continuous region of the through-holes 46, 47 before the bevelled surfaces 44, 45. At the lower end, the bevelled surfaces 44, 45 merge into a stepped portion 48 (see FIG. 6) which prevents the material of the ring 25 from being excessively weakened at that point and which ensures that the rear flanks 38, 39 of the pins 40, 41 rest against the stepped portion 48, as can be seen from FIG. 14, when the snap fastener 1 assumes the securing or locking position. In this manner, there is provided a barrier which prevents, when a drawing force is exerted on the shoe lace 8, the ring 25 from being rotated against the direction of the arrow 37 before the pins 40, 41 are withdraw.

Figure 12:
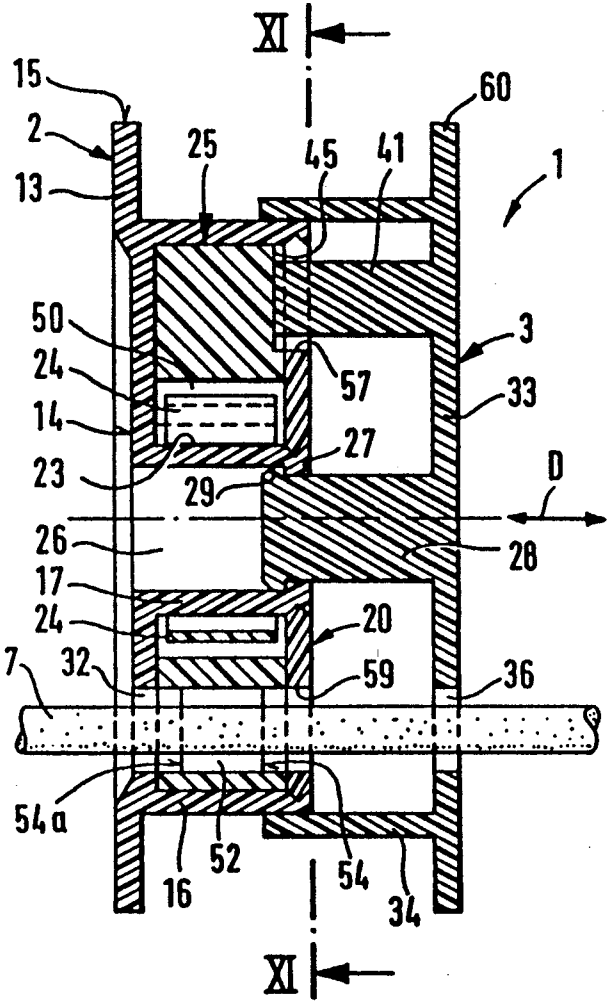

The circular ring 25 shown in FIGS. 5 and 6 has a circular cylindrical outer surface 49 which is only interrupted by the through-holes 46, 47 and partly by the bevelled surfaces 44, 45. The outer diameter of said outer surface almost corresponds to the inner diameter of the circular cylindrical side wall 16 of the inner sleeve 2. The ring 25 also includes a continuous inner borehole 50 whose diameter is larger than the outer diameter of the hub 17 so that there remains a space for the leaf spring 24 between the hub 17 and the ring 25, said leaf spring surrounding the hub like an arc of a circle and, as described before, being insertable at the free end thereof in the longitudinal slot 23. The spring 24 is arranged and dimensioned such that, when it is held in the longitudinal slot 23 in the released state it supports the ring 25 in an angular position relative to the inner sleeve 2, in which the pins 40, 41 rest against the upper end of the bevelled surfaces 44, 45, as shown in FIGS. 11 and 12. The ring 25 also includes boreholes 51, 52 vertically extending therethrough which, offset by about 90° relative to the position of the bevelled surfaces 44, 45, are arranged such that they are in alignment with the boreholes 31 and 32 of the inner sleeve 2 and the boreholes 35, 36 of the outer sleeve 3 when the snap fastener 1 assumes the operating position shown in FIGS. 9A, 10A and 11, 12. The boreholes 51, 52 are not shown in FIG. 6 for reasons of clarity. The boreholes 51, 52 get larger in the end portions thereof, the enlargement extending opposite the direction of rotation 37. The enlargements to form flat depressions 53, 54 as well as **53*a*, 54*a* which are provided with friction-increasing corrugation 55 in the front region adjacent the boreholes. When the snap fastener is secured, the shoe lace 8 is deflected and pressed into joints formed between the bottom 13 of the inner sleeve 2 and the opposite lower depressions 53*a*, 54*a* and into joints formed between the small cover plate 20 and the upper depressions 53, 54, which can be seen most clearly from FIG. 14. The ring 25** thus constitutes a shoelace deflecting member.

The pins 40, 41 extend through recesses 56, 57 formed in the edge of the small cover plate 20 (see FIG. 6) which has further boreholes 58, 59 aligned with the boreholes 31, 32 of the inner sleeve 2, the boreholes 35, 36 of the outer sleeve 3 and, when assuming the operating position shown in FIGS. 9A, 10A and 11, 12, with the boreholes 51, 52 of the ring 25.

The individual components are assembled such that, when the snap fastener 1 is in the open position where the outer sleeve 3 has not been completely placed over the inner sleeve 2 (see FIG. 12), the boreholes 31, 35, and 51 are aligned with one another in a direction parallel to direction D. The boreholes 32, 36, and 52 are aligned with one another in a direction parallel to the direction D. Thus, the end portions 6, 7 of the shoe lace 8 can be readily threaded through said boreholes. When a finger is pressed on the upper side of the snap fastener 1, i.e. on the upper side of the outer sleeve 3, the sleeves 2, 3 are brought longitudinally together in the direction of arrows D in FIG. 9B. As this occurs, the two pins 40, 41 disposed in the sleeve 3 act upon the bevelled through-holes 46, 47 of the inner ring 25. The ring 25 is thus made to rotate, the longitudinal movement of the pins 40, 41 being converted into a rotary movement of the ring 25 in the direction of the arrow 37 (see FIG. 10B). The rotary movement of the inner ring 25 draws the threaded shoe laces into joints 53, 54 defined between the inner ring 25 and the small cover plate 20, and into joints **53*a*, 54*a* defined between the inner ring 25 and the inner sleeve 2, the shoe lace thus being fixedly clamped and immovably locked. At the same time, said rotation of the ring 25 tensions the spring 24. By slightly pulling a gripping portion 60 of the outer sleeve 3, said gripping portion being formed by the protruding edge of the circular cover 33, the pins 40, 41 are withdrawn and the securing is released so that the ring 25 can be rotated into the unlocking position opposite the direction indicated by the arrow 37. The rotational movement is initiated by drawing force exerted on the shoe lace 8 and/or the tension of the spring 24**.

I claim:

1. A fastener for securing shoelaces, comprising:

first and second sleeve members movable toward and away from one another between locking and unlocking positions, said sleeve members together defining first and second passageways through which are insertable first and second end sections, respectively, of a shoelace when said sleeve members are in said unlocking position;

shoelace deflecting means disposed within an internal space formed by said sleeve members, said deflecting means being displaceable relative to said sleeve members in a locking direction in response to movement of said sleeve members to said locking position, such that first and second shoelace deflecting surfaces of said deflecting means are displaceable generally laterally across said first and second passageways, respectively; and actuating means disposed within said internal space and operably connected to one of said sleeves for displacing said deflecting means in said locking direction in response to movement of said sleeve members to said locking position so that said locking surfaces deflect portions of respective shoelace end sections out of alignment with said passageways to resist withdrawal of said shoelace end sections from said passageways.

2. A fastener according to claim 1 wherein said deflecting means comprises a deflecting member mounted for rotation about said axis, circumferentially spaced portions of said deflecting member defining said first and second deflecting surfaces.

3. A fastener according to claim 2 wherein each of said first and second passageways is defined by aligned throughbores formed in said sleeve members, said deflecting member including first and second throughbores alignable with said first and second passageways, respectively, for receiving said first and second shoelace end sections, said deflecting surfaces being defined by walls of said throughbores.

4. A fastener according to claim 3 wherein said activating means comprises projections mounted on one of said sleeves and being engageable with bevelled surfaces on said deflecting member.

5. A fastener according to claim 4 including spring means operably connected to said deflecting member for displacing said deflecting member in a direction opposite said locking direction in response to movement of said sleeve members to said unlocking direction.

6. A fastener for securing shoelaces, comprising:

a housing formed by an outer sleeve and an inner sleeve guided within said outer sleeve, so that said sleeves are movable toward and away from one another between locking and unlocking positions, said sleeve including boreholes which are aligned when said sleeves are in said unlocking position so that a shoelace can be inserted through said housing;

an inner body mounted in said housing for rotation relative to said sleeves about an axis, said inner body including boreholes alignable with said boreholes of said sleeves so that said shoelace is insertable through said boreholes of said inner body; and actuating means operably connected to said housing for effecting rotation of said inner body in response to movement of said sleeves to said locking position, to move said boreholes of said inner body out of alignment with said boreholes of said sleeves such that said shoelace is clamped against withdrawal from said housing.

7. A fastener according to claim 6, wherein said boreholes in said sleeves comprise two boreholes in said inner sleeve, and two boreholes in said outer sleeve arranged in alignment with said two boreholes of said inner sleeve, said aligned boreholes receiving respective shoelace end sections, said inner body being arranged to bend each shoelace end portion at a right angle when said sleeves are moved to said locking position, and means for reversely rotating said inner body when said sleeves are moved to said unlocking position to unclamp said shoelace end sections.

8. A fastener according to claim 6, wherein said sleeves are movable toward and away from one another along said axis, said actuating means comprising means for converting relative axial movement between said sleeves into rotary movement of said inner body.

9. A fastener according to claim 6, wherein said inner body includes at least one beveled surface, said actuating means comprising at least one projection connected to one of said sleeves and arranged to bear against said at least one bevelled surface to effect rotation thereof in response to movement of the sleeves to said locking position.

10. A fastener according to claim 9, wherein said at least one bevelled surface extends generally in a circumferential direction from a side of said inner body which is oriented perpendicularly to said axis.

11. A fastener according to claim 9, wherein said at least one projection is mounted on one of said sleeves on a surface thereof disposed opposite said at least one bevelled surfaces.

12. A fastener according to claim 9, wherein there are two said bevelled surfaces, and two said projections arranged to engage respective bevelled surfaces.

13. A fastener according to claim 12 including a cover plate disposed in said housing between said inner body and said outer sleeve, said cover plate including boreholes aligned with said boreholes of said sleeves, said cover plate also including recesses through which said projections pass.

14. A fastener according to claim 12, wherein said bevelled surfaces are diametrically opposed and are mirror-symmetrical relative to one another.

15. A fastener according to claim 12, wherein said boreholes of said inner body are angularly offset from respective ones of said bevelled surfaces by ninety degrees.

16. A fastener according to claim 12, wherein said inner body comprises a ring, said projections comprising pins carried by said outer sleeve for converting relative axial movement between said sleeves into rotary motion of said inner body.

17. A fastener according to claim 6, wherein said housing includes stop means for limiting the extent to which said sleeves can be moved apart.

18. A fastener according to claim 6, wherein said housing includes stop means for preventing relative rotation between said sleeves.

19. A fastener according to claim 6 including spring means for reversely rotating said inner body when said sleeves are moved to said unlocking position.

20. A fastener according to claim 6, wherein said inner and outer sleeves include inner and outer circular cylindrical portions, respectively, said inner circular cylindrical portion having an inner surface which guides an outer peripheral surface of said inner body during rotation of the latter.

21. A fastener according to claim 6, wherein said inner body is ring-shaped.

22. A fastener according to claim 21, wherein one of said sleeves includes an axially extending hub on which said inner body is rotatably mounted.

23. A fastener according to claim 6, wherein one of said sleeves includes an axial recess, the other sleeve including an axial projection received in said recess for preventing relative movement between said sleeves.

24. A fastener according to claim 23, wherein said recess is formed in an axial hub of said one sleeve.

25. A fastener according to claim 6, wherein said boreholes of said inner body extend parallel to said axis.

26. A fastener according to claim 6, wherein said boreholes of said inner body are diametrically opposed.

27. A fastener according to claim 6 including a cover plate disposed in said housing between said inner body and said outer sleeve, said cover plate including boreholes aligned with said boreholes of said sleeves.

28. A fastener according to claim 27, wherein said cover plate includes at least one recess through which said actuating means passes.

29. A fastener according to claim 28, wherein said inner body and said cover plate form joints between one another into which said shoelace is clamped when said sleeves are moved to said locking position.

30. A fastener according to claim 6, wherein said inner body includes two boreholes, and a depression extending from an end of each such borehole in a direction opposite a direction of rotation of said inner body during shoelace clamping operating, said depressions clampingly receiving respective end sections of said shoelace.

31. A fastener according to claim 30, wherein each depression includes a surface irregularity for increasing the frictional clamping force between said depressions and said shoelace end sections.

32. A fastener according to claim 6, wherein a portion of said outer sleeve is exposed for manual gripping by a user.

33. A fastener according to claim 6, wherein said housing has a generally cylindrical shape.

34. A fastener according to claim 6 including elements in which the ends of said shoelace end sections are held, said elements being larger than said boreholes in said sleeves to prevent said shoelace end sections from being withdrawn from said housing.

35. A fastener according to claim 34, wherein each of said element includes a bent passage in which a terminal end of a shoelace is disposed.

36. A fastener according to claim 6, wherein said shoelace passes through said housing generally parallel to said axis.

* * * * *